US006311446B1

(12) United States Patent
Loyd

(10) Patent No.: US 6,311,446 B1
(45) Date of Patent: Nov. 6, 2001

(54) PREFABRICATED HIP ROOF

(75) Inventor: Buzz K. Loyd, Rancho Cucamonga, CA (US)

(73) Assignee: California Acrylic Industries, Inc., Pomona, CA (US)

( * ) Notice: Subject to any disclaimer, the term of this patent is extended or adjusted under 35 U.S.C. 154(b) by 0 days.

(21) Appl. No.: 09/483,312

(22) Filed: Jan. 14, 2000

(51) Int. Cl.[7] ..... E04D 1/00

(52) U.S. Cl. ..... 52/537; 52/518; 52/199; 52/542

(58) Field of Search ..... 52/537, 542, 529, 52/538, 536

(56) References Cited

U.S. PATENT DOCUMENTS 4,031,683 * 6/1977 Walker ..... 52/536
4,610,114 * 9/1986 Rodriguez ..... 52/93
4,648,217 * 3/1987 Watson ..... 52/90
4,686,802 * 8/1987 O'Driscoll ..... 52/94
5,174,076 * 12/1992 Schiddegger et al. ..... 52/199
5,201,158 * 4/1993 Bayley et al. ..... 52/537
5,297,374 * 3/1994 Himes ..... 52/641
5,507,126 * 4/1996 Wu ..... 52/536
6,088,983 * 7/2000 Applebee ..... 52/282.1
6,112,493 * 9/2000 Rickman ..... 52/640
6,119,417 * 9/2000 Valverde et al. ..... 52/223.7
6,164,021 * 12/2000 Huber et al. ..... 52/43

* cited by examiner

*Primary Examiner*—Carl D. Friedman
*Assistant Examiner*—Patrick J Chavez
(74) *Attorney, Agent, or Firm*—Lyon & Lyon LLP

(57) ABSTRACT

An assembled hip roof includes a plurality of roofing panels as well as the rafters of the underlying structure that support those panels. Ridge caps preferably extend over the panels at the hip rafters. In a preferred embodiment, a set of metal roofing panels is designed and shaped for use on a specific hip roof configuration, using a minimal number of separate panels. In a preferred embodiment especially suitable for larger area roofs, a plurality of the panels interlock with one another. The panels are preferably coated on one or both sides for protection against scratching during handling and assembly. One or more of the panels preferably include decorative relief, such as the appearance of overlapping wooden boards.

In a preferred embodiment of the method of the invention, the panels are manufactured from rolled steel. Plastic coating is preferably applied to the rolled steel after it is painted and before the steel is cut into panels and given decorative relief, in order to protect the panels from damage.

10 Claims, 4 Drawing Sheets

PREFABRICATED HIP ROOF

BACKGROUND OF THE INVENTION

The field of invention is roofing, and more specifically a hip roof wherein prefabricated metal panels for indexing with the rafters of a hip roof and a method of making the panels are provided.

An outdoor gazebo is a pleasant place to spend a day. Many people place chairs, tables and other furnishings in a gazebo, allowing it to function as an outdoor living room where people can relax in the shade while enjoying the breezes and sunshine of a nice day outdoors. Other people build gazebos around hot tubs or spas, providing shade and privacy, and preventing falling leaves and other debris from falling into the spa. Yet the pleasant enjoyment of a gazebo can with time be impaired by leakage through and deterioration of the roof. Further, an unattractive gazebo can be a source of scorn and ridicule by neighbors and passersby, rather than a source of pride and enjoyment.

Gazebos and similar outbuildings are often built as do-it-yourself projects by homeowners, many of whom have no experience or minimal experience with tools. An easily-assembled gazebo kit thus increases the success rate of the casual do-it-yourselfer, and results in greater satisfaction with the finished product. Such a kit also enables the skilled contractor to save time and materials, allowing for more economical construction in a shorter time. However, present gazebo kits and plans do not provide for simple, easily-assembled, and durable roof structures.

A metal roof is desirable because it is durable, accepts paint and coloration, resists warping, and is immune to the deleterious effects of the sun's ultraviolet rays. Some presently-known metal roof kits and plans call for or furnish a plurality of sheet metal squares similar to shingles for roof construction. Such squares are typically twelve inches on a side. While a metal roof constructed from a large number of sheet metal squares has many of the advantages of a metal roof, the assembly process is difficult and labor-intensive. It can be dangerous for an inexperienced do-it-yourselfer to stand on a ladder for a long time to attach these sheet metal squares to a roof structure. Further, a significant number of wood rafters are required to allow for attachment of the sheet metal squares. Constructing those rafters is difficult and complex, and adds to the cost of the project. Further, due to the large number of sheet metal squares required to create the finished roof, the potential for leakage and for incorrect and unattractive assembly is substantial. In addition, sheet metal squares presently used are susceptible to scratches and scuffs during transport and installation. While it is known to attempt to protect such squares against long-term damage by applying a permanent powder coating to them, that powder coating does not protect against transport and installation damage. Further, the powder coating may not be aesthetically pleasing to all people, and is permanently affixed to the metal.

Other presently-known kits and plans call for or furnish wood shingles or slats. While such wood shingles and slats may be attractive, substantial work is required to attach a number of shingles or slats to the roof of even a small structure. Such work is difficult, tedious, and easy to perform incorrectly, resulting in frustrating rework or an imperfect and unattractive finished product. As with metal squares, a large number of wooden rafters are typically required on which to hang such shingles or slats, or a solid underroof of, for example, plywood sheets, is utilized, both of which increase the cost of the project and the complexity of its construction. Further, wood shingles and slats, and other forms of wooden roof assemblies, are susceptible to fire, dry rot, termite infestation, warping, and other forms of deterioration common to wood left outdoors for long periods of time.

Some other presently-known kits and plans call for or furnish unitary vacuum-molded plastic roof pieces. However, plastic roofs may be less durable than metal roofs, and cannot be easily painted. Further, they may be more susceptible to warping due to thermal effects than metal roofs.

SUMMARY OF THE INVENTION

An object of embodiments of the invention is to simplify construction of a metal roof for a structure. Another object is to minimize the number of roofing panels required for construction of a selected metal roof. Another object is to provide a method for manufacturing the components of such a metal roof.

According to the invention, a metal roof for a structure is provided. The metal roof of the invention is fabricated from metal panels whose size and shape is selected to minimize the number of roofing panels and the number of different shapes of roofing panels required to provide a completed roof for the structure. Each roofing panel preferably includes decorative relief to provide a desired texture and look to the completed roof, such as the appearance of overlapping wooden boards.

There is also provided a method of fabricating the metal panels which form the roof of the invention. According to the method of the invention, a source of raw metal, such as coiled steel, of a desired width and thickness is selected. The metal is then painted on one or both sides in any desired color such as by uncoiling the coiled steel, spray painting the uncoiled section and, after the paint dries, recoiling the steel. Preferably a protective coating, such as PVC, is next applied in a similar process. The coiled, painted and coated metal may then be uncoiled and cut into sheets of a desired size. The sheets are then cut into the size and shape selected for the roof design and placed in a die stamping machine to create the desired decorative relief on the sheet, such as the appearance of overlapping wooden boards.

According to the invention, for a given roof design the designer can select a metal roof having the fewest number of fabricated metal panels. The number and shape of the individual parts selected will be determined by several factors. One factor is the shape of the completed roof itself, including whether or not the roof will close at the top or have an opening on the top to provide open air access or a skylight. Another factor is dependent on fabrication techniques such as the available size and capabilities of metal processing and die stamping machines. Yet another factor is the assembly requirements anticipated. For example, professional assemblers with the necessary equipment can handle larger, heavier panels, while anticipated home assembly may dictate a larger number of smaller, lighter panels.

Generally, the advantages of the invention are achieved by selecting the fewest number and shapes of panels consistent with the roof design fabrication requirements, assembly requirements and material requirements.

In one aspect of a preferred embodiment, a metal roof is constructed from a plurality of metal roofing panels comprising one or more prefabricated nonrectangular roofing panels. In a further aspect of a preferred embodiment, one or more rectangular roofing panels are included in the metal roof. In a further aspect of a preferred embodiment, a set of metal roofing panels is designed and shaped for use on a specific roof configuration. In a further aspect of a preferred embodiment, fewer roofing panels are required than the number of shingles or squares that would be needed in the prior art.

In another aspect of a preferred embodiment, a plurality of the roofing panels interlock with one another.

In another aspect of a preferred embodiment, the roofing panels are coated with plastic on one or both sides for protection against damage during handling and assembly. The coating may be removed before or after assembly. In a further aspect of a preferred embodiment, this coating is polyvinyl chloride.

In another aspect of a preferred embodiment, one or more of the roofing panels include decorative relief In a further aspect of a preferred embodiment, such decorative relief includes the appearance of overlapping wooden boards.

In another aspect of a preferred embodiment, the roofing panels are manufactured from rolled steel.

In another aspect of a preferred embodiment, plastic coating is applied to the rolled steel after it is painted and before the steel is cut into roofing panels and stamped with decorative relief, in order to protect the roofing panels from damage.

DETAILED DESCRIPTION OF THE PREFERRED EMBODIMENTS

Figure 1:
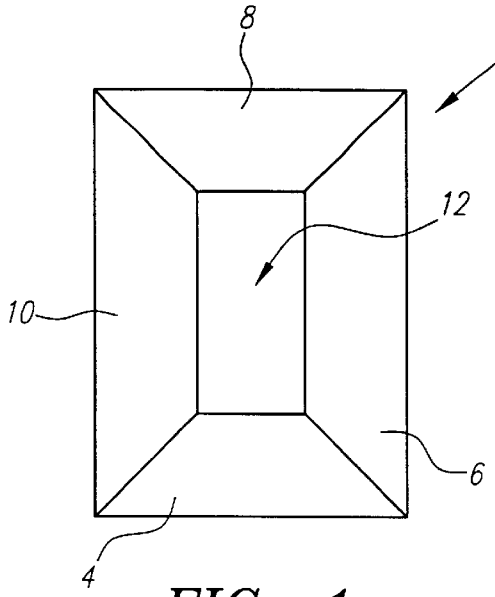
FIG. 1 is a top view of an assembled roof according to a preferred embodiment.

Referring to FIG. 1, a top view of an assembled roof 2 according to a preferred embodiment may be seen. The assembled roof 2 is located atop a structure such as a gazebo. It is within the scope of the preferred embodiments that the structure be a residence such as a detached home, condominium or prefabricated trailer, a commercial structure, or an outbuilding such as a garage, shed, or animal enclosure. The assembled roof 2 may also be of varying cross-section and need not be symmetrical. The assembled roof 2 includes a plurality of roofing panels as well as the rafters of the underlying structure that support those roofing panels. As viewed from above, the perimeter of the assembled roof 2 is preferably configured to correspond to the structure below. That underlying structure is typically rectangular, but it may take other shapes, such as but not limited to pentagonal, hexagonal or octagonal forms. The assembled roof 2 is preferably a hip roof, which is a roof having at least four sloping edges and sides, the sides forming at least four contiguous and converging planes.

Figure 2:
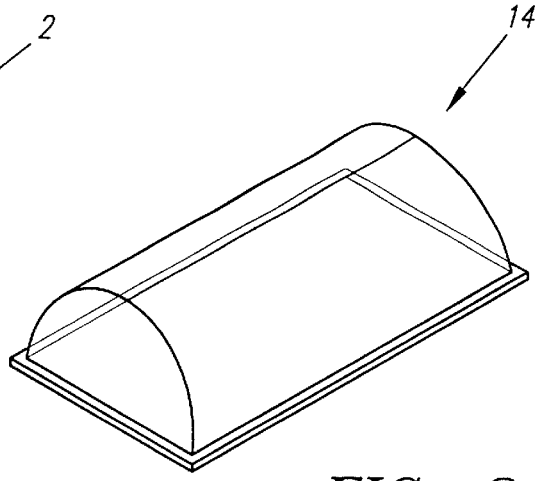
FIG. 2 is a perspective view of a center cap for use with the assembled roof of FIG. 1.

In a first preferred embodiment, the assembled roof 2 includes a first roofing panel 4, a second roofing panel 6, a third roofing panel 8, and a fourth roofing panel 10. This preferred embodiment of the assembled roof 2 includes a substantially rectangular opening 12, which is defined by the upper edges of the roofing panels. The opening 12 is optionally covered with a center cap 14, which is shown in FIG. 2. The center cap 14 may be a skylight, to admit light into the structure below, or may be another translucent or opaque structure, depending on the aesthetic preference of the user. The opening 12 may instead be left open, with the center cap 14 not utilized, depending on the climate and on the preference of the user.

Referring to FIGS. 3–6, the first roofing panel 4, the second roofing panel 6, the third roofing panel 8, and the fourth roofing panel 10 are seen. The first roofing panel 4 may be trapezoidal, with its lower edge 16 longer than its upper edge 18. The first roofing panel 4 is preferably substantially planar, that is, it is preferably a thin sheet lying substantially in a single plane. Other shapes corresponding to the structure being covered are also within the scope of the invention. For example, the trapezoidal first roofing panel 4 may be replaced by two triangular roofing panels and one or more rectangular roofing panels. See, for example, FIG. 13 and FIG. 15. It is not required that the first roofing panel 4 and the third roofing panel 8 be the same size, nor that the second roofing panel 6 and the fourth roofing panel 10 be the same size. That is, the portion of the assembled roof 2 covered by the second roofing panel 6 could be larger than the portion of the assembled roof 2 covered by the fourth roofing panel 10, or vice versa. The same may be said for the first roofing panel 4 and the third roofing panel 8. Thus, the invention is not limited to symmetrical roof designs because the advantages of the invention may be obtained with any roof design having substantially flat portions.

Figure 3:
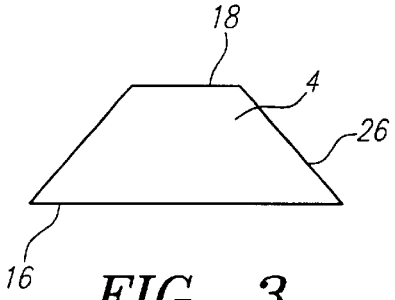
FIG. 3 is a front view of the first roofing panel of FIG. 1.
Figure 7:
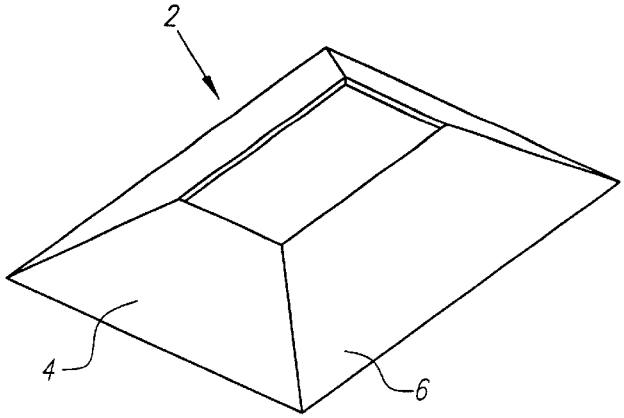
FIG. 7 is a perspective view of the assembled roof of FIG. 1.

In FIG. 3, the center of the upper edge 18 may preferably be located substantially at the point where a line perpendicular to the upper edge 18 and in the plane of the first roofing panel 4 intersects the center of the lower edge 16. That is, the first roofing panel 4 is preferably substantially bilaterally symmetrical. The trapezoidal shape of the first roofing panel 4 follows from the shape of the assembled roof 2. Turning to FIG. 7, it is seen that the assembled roof 2 slopes such that the first roofing panel 4 is positioned at an angle to the horizontal. Thus, for the first roofing panel 4 to slope at an angle to the horizontal, and for its lower edge 16 to form part of a perimeter of a rectangle that is larger than the perimeter of the rectangle formed by the opening 12, of which the upper edge 18 of the first roofing panel 4 forms a part, the first roofing panel 4 is, in the embodiment shown, necessarily substantially trapezoidal. In a preferred embodiment, the distance between the upper edge 18 and the lower edge 16 is sixty inches or less, to prevent the first roofing panel 4 from being too large or heavy to be conveniently assembled, to facilitate packaging and transport, and due to manufacturing constraints. However, it is still within the scope of the invention to provide a first roofing panel 4 having a distance of greater than sixty inches between the upper edge 18 and the lower edge 16.

The first roofing panel 4 is preferably constructed from sheet metal thick enough to provide for a durable first roofing panel 4 but not so thick that it is too heavy for installation onto a wood-frame structure or is uneconomical. Preferably, galvanized sheet steel is used, having a thickness between 22 gauge and 33 gauge. Advantageously, 26 gauge sheet steel is used because it offers durability while being lighter than higher gauge steels. Of course, other metals possessing the appropriate strength and durability may be used, including but not limited to other types of steel, or to tin or aluminum, depending on the aesthetic or other preferences of the user. It is also contemplated that the first roofing panel 4 may be up to 1.5 inches thick in applications where durability is a particular concern.

Figure 5:
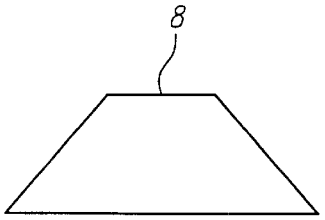
FIG. 5 is a front view of the third roofing panel of FIG. 1.

Turning to FIG. 5, the third roofing panel 8 is substantially identical to the first roofing panel 4, due to their symmetrical placement within the symmetrical structure of the assembled roof 2 in the embodiment shown. Thus, the disclosure above relating to the first roofing panel 4 also applies to the third roofing panel 8.

Figure 4:
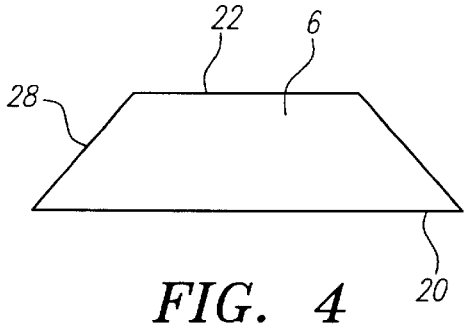
FIG. 4 is a front view of the second roofing panel of FIG. 1.

Turning to FIG. 4, the second roofing panel 6 is seen. The second roofing panel 6 is preferably trapezoidal, with its lower edge 20 longer than its upper edge 22. As with the first roofing panel 4, other shapes corresponding to the structure being covered are also within the scope of the preferred embodiment. For example, the trapezoidal second roofing panel 6 may be replaced by two triangular roofing panels and one or more rectangular roofing panels. For a rectangular roof that is not square, the second roofing panel 6 is longer than the first roofing panel 4. Thus, the lower edge 20 of the second roofing panel 6 is longer than the lower edge 16 of the first roofing panel 4, and the upper edge 22 of the second roofing panel 6 is longer than the upper edge 18 of the first roofing panel 4. Preferably, the center of the upper edge 22 is located substantially at the point where a line perpendicular to the upper edge 22 and in the plane of the second roofing panel 6 intersects the center of the lower edge 20. That is, the second roofing panel 6 is preferably bilaterally symmetrical. The trapezoidal shape of the second roofing panel 6 follows from the shape of the assembled roof 2. Turning to FIG. 7, it is seen that the assembled roof 2 slopes such that the second roofing panel 6 is positioned at an angle to the horizontal. Thus, for the second roofing panel 6 to slope at an angle to the horizontal, and for its lower edge 20 to form part of a perimeter of a rectangle that is larger than the perimeter of the rectangle formed by the opening 12, of which the upper edge 22 of the second roofing panel forms a part, the second roofing panel 6 is, in the embodiment shown, necessarily substantially trapezoidal. The thickness and material of the second roofing panel 6 are as disclosed above in regard to the first roofing panel 4.

Figure 6:
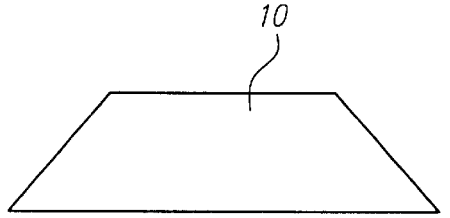
FIG. 6 is a front view of the fourth roofing panel of FIG. 1.

Turning to FIG. 6, the fourth roofing panel 10 is substantially identical to the second roofing panel 6, due to their symmetrical placement within the symmetrical structure of the assembled roof 2 in the embodiment shown. Thus, the disclosure above relating to the second roofing panel 6 also applies to the fourth roofing panel 10.

In a preferred embodiment, a coating (not shown) covers at least one side of the first roofing panel 4, the second roofing panel 6, the third roofing panel 8, and the fourth roofing panel 10. Advantageously, the coating covers both sides of each roofing panel. The coating acts to protect the roofing panels from scratches and scuffs during transport and installation. In a preferred embodiment, the coating is removable before or after installation of the roofing panels, and is preferably removed from the roofing panels after installation for cosmetic reasons. In a preferred embodiment, the coating is a plastic film. Advantageously, the plastic film is polyvinyl chloride. In an alternate embodiment, the coating may comprise any substance which adheres to the roofing panel during transport and installation and is removable from the roofing panel after installation. In another alternate embodiment, a sheet of protective material having an adhesive coating is attached to the roofing panel.

Figure 8:
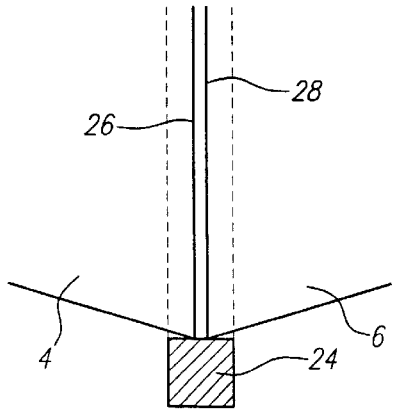
FIG. 8 is a perspective view of a joint between the first roofing panel and the second roofing panel of FIG. 1.
Figure 19:
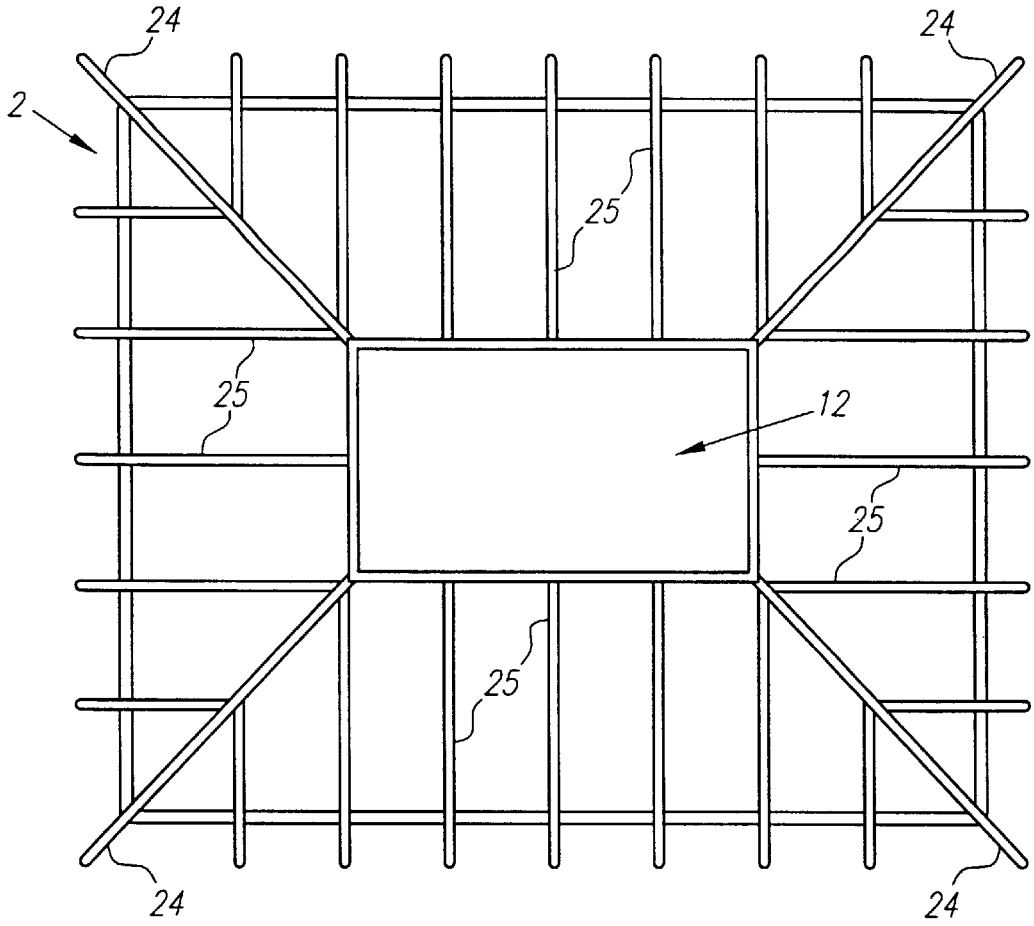
FIG. 19 is a top view of a roof with the panels not shown in order to show the rafters, such as may be used in the assembled roofs according to FIG. 1, FIG. 10, FIG. 13 and FIG. 15.

Turning to FIG. 8, a portion of the assembly process can be seen. The assembled roof 2 includes a plurality of rafters, of which the hip rafter 24 is one. Referring to FIG. 19 as well, the assembled roof 2 is shown without the roofing panels to reveal a preferred set of rafters underneath, including hip rafters 24 and intermediate rafters generally designated with the reference number 25. The hip rafters 24 form ridges from which both the first roofing panel 4 and the second roofing panel 6 slope away. In a preferred embodiment, the rafters are spaced further than twelve inches apart. Each hip rafter 24 preferably extends from a corner of the underlying structure to a comer of the opening 12. As seen in FIG. 3 and FIG. 8, the first roofing panel 4 is placed onto a hip rafter 24 such that a right edge 26 of the first roofing panel 4 rests on a hip rafter 24. Preferably, the right edge 26 of the first roofing panel 6 extends to approximately midway across the surface of the hip rafter 24. That is, the first roofing panel 6 is indexed to a hip rafter 24, as well as a hip rafter 24 at the opposite end of the first roofing panel. Of course, for larger assembled roofs the panels may index on one of the intermediate rafters 25 between the hip rafters 24.

The right edge 26 of the first roofing panel 4 is attached to a hip rafter 24, preferably by nailing it to a hip rafter 24. However, such attachment may be performed by screwing the right edge 26 of the first roofing panel 4 to a hip rafter 24, or by using adhesives or other means that provide for secure attachment and minimize or prevent leakage. Similarly, referring to FIG. 4 and FIG. 7, the second roofing panel 6 is placed onto the same hip rafter 24 to which the first roofing panel 4 is attached, such that a left edge 28 of the second roofing panel 6 extends to approximately midway across the surface of the hip rafter 24 to which the right edge 26 of the first roofing panel 4 is attached. The left edge 28 of the second roofing panel 6 is then attached to the hip rafter 24, preferably by nailing it to the hip rafter 24. However, adhesives or other forms of attachment may be used instead, if desired.

For the lower edge 16 of the first roofing panel 4 to be substantially parallel to the plane of the ground and substantially perpendicular to the lower edge 20 of the second roofing panel 6, while simultaneously allowing the right edge 26 of the first roofing panel 4 to rest on the rafter 24, the angle between the right edge 26 and the lower edge 16 is selected based on the overall dimensions of the roof and the angle to the horizontal at which the first roofing panel 4 will be placed. The determination of that angle based on these simple relationships is within the knowledge of one of ordinary skill in the art.

Figure 9:
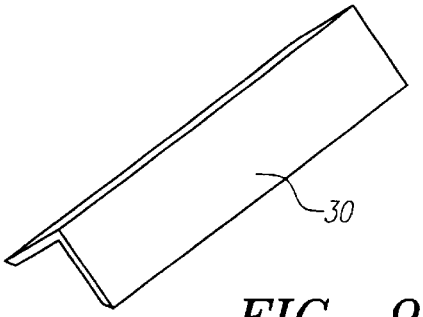
FIG. 9 is a perspective view of a ridge cap.

After the first roofing panel 4 and the second roofing panel 6 have been attached to the rafter 24, a ridge cap 30 is preferably placed over the joint between the first roofing panel 4 and the second roofing panel 6. The ridge cap 30 is shown in FIG. 9. In a preferred embodiment, the ridge cap 30 takes the shape of a linear structure having a substantially V-shaped cross-section. The cross-section of the ridge cap 30 is constructed to allow a substantially close and moisture-resistant fit between the ridge cap 30 and both the first roofing panel 4 and the second roofing panel 6 along substantially all of the right edge 26 of the first roofing panel 4 and the left edge 28 of the second roofing panel 6. Thus, the angles at which the first roofing panel 4 and second roofing panel 6 extend to the horizontal drive the cross-sectional shape of the ridge cap 30. The ridge cap 30 is preferably attached to the first roofing panel 4 and the second roofing panel 6 by screwing it into the rafter 24 through both the first roofing panel 4 and the second roofing panel 6. Of course, other means of attachment, such as but not limited to nails and adhesives, are within the scope of the first preferred embodiment. The ridge cap 30 acts to protect the joint between the first roofing panel 4 and the second roofing panel 6 from the elements, and to minimize or prevent leakage through the joint between the first roofing panel 4 and the second roofing panel 6. Like the roofing panels, the ridge cap 30 is preferably constructed from sheet metal. Of course, other materials such as vinyl may be used if desired, so long as such materials allow for attachment to the roofing panels and for reducing or eliminating leakage between the first roofing panel 4 and the second roofing panel 6. Preferably, the ridge cap 30 has decorative relief substantially matching that of the first roofing panel 4 and the second roofing panel 6, and in a way that allows for alignment of the decorative relief features where such alignment is aesthetically pleasing, as where the decorate relief takes the form of overlapping wooden boards. It is within the scope of the preferred embodiment to utilize a plurality of ridge caps 30, preferably overlapping one another, to protect the seam between the first roofing panel 4 and the second roofing panel 6. Alternately, other means than the ridge cap 30 may be used to minimize or prevent leakage through the joint between the first roofing panel 4 and the second roofing panel 6.

The third roofing panel 8 and the fourth roofing panel 10 are incorporated into the assembled roof 2 in a similar fashion. In a preferred embodiment, there are four separate ridge caps 30, corresponding to the four separate joints between roofing panels.

In a preferred embodiment, the center cap 14 covers the opening 12 in the assembled roof 2. The center cap 14 is preferably attached to the assembled roof 2, or the structure underlying it, with brackets (not shown). However, other means of attachment may be used that are secure and that minimize or prevent leakage through the opening 12; such other means of attachment are within the knowledge of one of ordinary skill in the art.

It is desired in a preferred embodiment to minimize the number of roofing panels and the number of different shapes of roofing panels included in the assembled roof 2, in order to reduce manufacturing costs and to facilitate assembly. In the first preferred embodiment, only four roofing panels having two different shapes are used, thereby utilizing a minimal number of both the number of roofing panels and the number of different shapes of roofing panels. Of course, other preferred embodiments are possible in which a larger number of roofing panels are provided, or a larger number of shapes, depending on a variety of factors such as the shape of the completed roof, the assembly and packaging requirements for the roofing panels, and the techniques used to fabricate the roofing panels.

Figure 10:
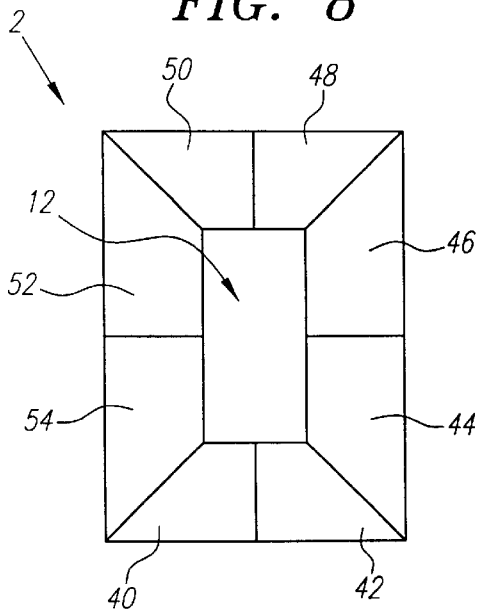
FIG. 10 is a top view of an assembled roof according to a second preferred embodiment.
Figure 11:
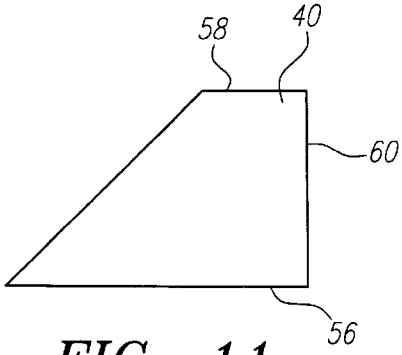
FIG. 11 is a front view ofthe first roofing panel of FIG. 10.

Accordingly, a second preferred embodiment of the assembled roof 2 is shown in FIG. 10. As in the first preferred embodiment, the perimeter of the assembled roof 2 is preferably rectangular. In the second preferred embodiment, the assembled roof 2 includes a first roofing panel 40, a second roofing panel 42, a third roofing panel 44, a fourth roofing panel 46, a fifth roofing panel 48, a sixth roofing panel 50, a seventh roofing panel 52, and an eighth roofing panel 54. The second preferred embodiment also may include a substantially rectangular opening 12 which is preferably covered with a center cap 14. The second preferred embodiment is advantageously utilized for larger roofs than the first preferred embodiment Referring to FIG. 11, the first roofing panel 40 is seen. The first roofing panel 40 is preferably trapezoidal, with its lower edge 56 longer than its upper edge 58. Preferably, the right edge 60 of the first roofing panel 40 is substantially perpendicular to both the lower edge 56 and the upper edge 58 of the first roofing panel 40. The trapezoidal shape of the first roofing panel 40 follows from the shape of the assembled roof 2, as discussed with regard to the first preferred embodiment. The orientation of the right edge 60 at a substantially right angle to both the lower edge 56 and the upper edge 58 follows from the need to form a joint with the second roofing panel 42, which is preferably a mirror image of the first roofing panel 40. Thus, the preferred embodiment of the first roofing panel is not bilaterally symmetrical. Other orientations of the right edge 60 are possible, but the orientation at a substantially right angle is preferred due to the simplicity of manufacture that it allows.

In a preferred embodiment, the first roofing panel 40 and the fifth roofing panel 48 are substantially identical, and the second roofing panel 42 and the sixth roofing panel 50 are preferably substantially mirror images of the first roofing panel 40.

Figure 12:
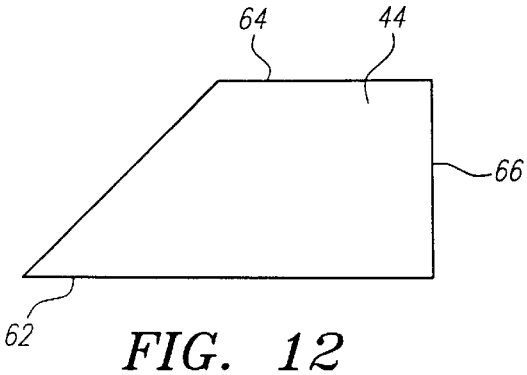
FIG. 12 is a front view of the third roofing panel of FIG. 10.

Referring to FIG. 12, the third roofing panel 44 is seen. The second roofing panel is preferably trapezoidal, with its lower edge 62 longer than its upper edge 64. The third roofing panel 44 is longer than the first roofing panel 40. Thus, the lower edge 62 of the third roofing panel 44 is longer than the lower edge 56 of the first roofing panel 40, and the upper edge 64 of the third roofing panel 44 is longer than the upper edge 58 of the first roofing panel 40. Preferably, the right edge 66 of the third roofing panel 44 is substantially perpendicular to both the upper edge 64 and the lower edge 62 of the third roofing panel 44. Other orientations of the right edge 66 are possible, but the orientation at a substantially right angle is preferred due to the simplicity of manufacture that it allows. The purpose of the trapezoidal shape of the third roofing panel 44 has been discussed above.

In a preferred embodiment, the third roofing panel 44 and the seventh roofing panel 52 are substantially identical, and the fourth roofing panel 46 and the eighth roofing panel 54 are preferably substantially mirror images of the third roofing panel 44.

The material and coating of the first preferred embodiment, as disclosed above, apply here as well. Further, the assembly process proceeds in the same way for the second preferred embodiment as the first preferred embodiment; the roofing panels are placed onto rafters, secured to the rafters, and the joints are covered with ridge caps 30. The joints between panels that exist in locations other than adjacent to the rafters are also covered with ridge caps 30; those ridge caps 30 are preferably not V-shaped, but rather are substantially planar, and include decorative relief substantially matching the pattern of decorative relief of the underlying panels. This use of the ridge caps 30 extends to the additional preferred embodiments disclosed below.

Figure 13:
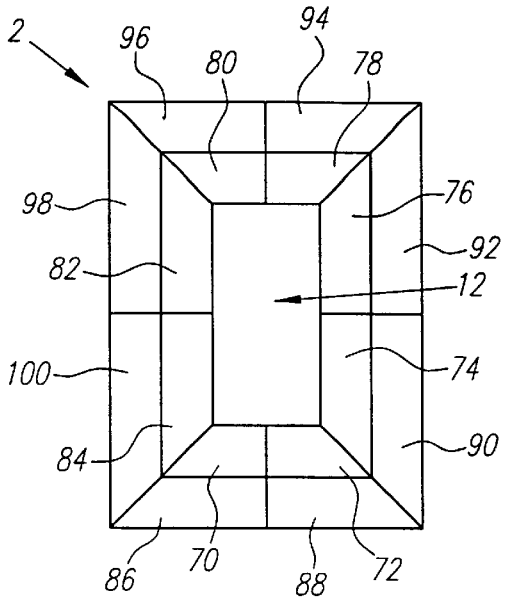
FIG. 13 is a top view of an assembled roof according to a third preferred embodiment.

A third preferred embodiment of the assembled roof 2 is shown in FIG. 13. As in the first preferred embodiment, the perimeter of the assembled roof 2 is preferably rectangular. In the third preferred embodiment, the assembled roof 2 includes a first roofing panel 70, a second roofing panel 72, a third roofing panel 74, a fourth roofing panel 76, a fifth roofing panel 78, a sixth roofing panel 80, a seventh roofing panel 82, an eighth roofing panel 84, a ninth roofing panel 86, a tenth roofing panel 88, an eleventh roofing panel 90, a twelfth roofing panel 92, a thirteenth roofing panel 94, a fourteenth roofing panel 96, a fifteenth roofing panel 98, and a sixteenth roofing panel 100. As in the first two preferred embodiments, the third preferred embodiment may include a substantially rectangular opening 12 which is preferably covered with a center cap 14. The third preferred embodiment is advantageously utilized for larger roofs than the second preferred embodiment.

The third preferred embodiment is similar to the second preferred embodiment. Each of the roofing panels of the second preferred embodiment is replaced with two roofing panels in the third preferred embodiment. For example, in place of the first roofing panel 40 of the second preferred embodiment , the third preferred embodiment utilizes a first roofing panel 70 and a second roofing panel 86. In the third preferred embodiment, two tiers of roofing panels are utilized, as seen in FIG. 13. In a preferred embodiment, each tier has substantially the same height. However, it is within the scope of the third preferred embodiment to provide two tiers having different heights. The materials and coating of the individual roofing panels are as described above for the first preferred embodiment. The details and dimensions of each roofing panel in the third preferred embodiment will be apparent based on the disclosure of the second preferred embodiment. It will be appreciated that each of the roofing panels in the third preferred embodiment are trapezoidal, and are trapezoidal in a similar configuration as disclosed with regard to the second preferred embodiment.

Figure 14:
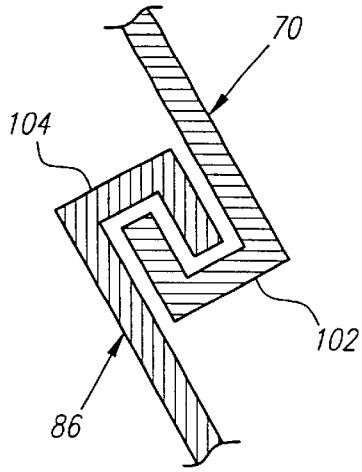
FIG. 14 is a cross-section view of an interconnection between the first and ninth roofing panels of FIG. 13.

The third preferred embodiment also includes an interconnection between upper and lower roofing panels. As an example, referring to FIG. 14, the interconnection between the first roofing panel 70 and the ninth roofing panel 86 is shown in greater detail. Preferably, the bottom edge 102 of the first roofing panel 70 bends inward and upward to form a substantially U-shaped channel. A V-shaped channel or other suitable shape could alternately be formed. The upper edge 104 of the ninth roofing panel 86 preferably bends outward and downward to form a substantially U-shaped channel corresponding to the analogous channel on the bottom edge 102 of the first roofing panel 70. Of course, a V-shaped channel could alternately be formed to correspond with a V-shaped channel on the bottom edge 102 of the first roofing panel 70. These corresponding channels preferably interlock and hold the first roofing panel 70 to the ninth roofing panel 86, and further act to minimize or prevent leakage. Preferably, the channels interlock in a manner which further increases structural stability and enhances leakage protection. Such enhancements are within the scope of the invention and are well known to those of ordinary skill in the art. Other corresponding pairs of upper and lower roofing panels preferably include such channels; advantageously all of the roofing panels have such channels in order to increase structural stability and minimize or prevent leakage.

The material and coating of the first preferred embodiment, as disclosed above, apply here as well. Further, the assembly process proceeds in the same way for the third preferred embodiment as the first preferred embodiment; the roofing panels are placed onto rafters, secured to the rafters, and the joints are covered with ridge caps 30.

Figure 15:
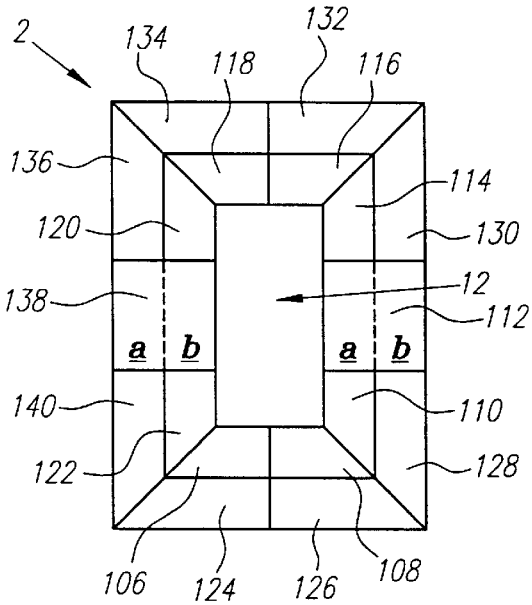
FIG. 15 is a top view of an assembled roof according to a fourth preferred embodiment.

A fourth preferred embodiment of the assembled roof is shown in FIG. 15. As in the embodiments above, the perimeter of the assembled roof 2 is preferably rectangular. In the fourth preferred embodiment, the assembled roof 2 includes a first roofing panel 106, a second roofing panel 108, a third roofing panel 110, a fourth roofing panel 112, fifth roofing panel 114, a sixth roofing panel 116, a seventh roofing panel 118, an eighth roofing panel 120, a ninth roofing panel 122, a tenth roofing panel 124, an eleventh roofing panel 126, a twelfth roofing panel 128, a thirteenth roofing panel 130, a fourteenth roofing panel 132, a fifteenth roofing panel 134, a sixteenth roofing panel 136, a seventeenth roofing panel 138, and an eighteenth roofing panel 140. As in the previous preferred embodiments, the fourth preferred embodiment may include a substantially rectangular opening 12 which is preferably covered with a center cap 14. The fourth preferred embodiment is advantageously utilized for larger roofs than the third preferred embodiment.

As can be seen from FIG. 15, the fourth preferred embodiment is similar to the third preferred embodiment, and the disclosure regarding the third preferred embodiment applies equally here. The difference is the inclusion of two rectangular roofing panels, the fourth roofing panel 112 and the seventeenth roofing panel 138. These rectangular roofing panels are useful when the assembled roof 2 has a rectangular perimeter where one dimension is significantly longer than the other one. Use of the rectangular roofing panels then obviates the need to make the trapezoidal roofing panels in an inconveniently large size to be useful. Optionally, the fourth roofing panel 112 can be provided in two sections, 112*a* and 112*b*, as shown in FIG. 15. Similarly, the seventeenth roofing panel 138 can optionally be provided in two sections, 138*a* and 138*b*, as shown in FIG. 15. Providing the fourth roofing panel 112 and/or the seventeenth roofing panel 138 in multiple sections may be desirable from a packaging standpoint, or to reduce the size and weight of either the fourth roofing panel 112 or the seventeenth roofing panel 138 to allow for easier handling of those panels as they are assembled into the assembled roof 2.

The material and coating of the first preferred embodiment, as disclosed above, apply here as well. Further, the assembly process proceeds in the same way for the fourth preferred embodiment as the first preferred embodiment; the roofing panels are placed onto rafters, secured to the rafters, and the joints are covered with ridge caps 30.

It will be apparent from the disclosure above that other combinations of trapezoidal roofing panels, with or without the accompanying utilization of one or more rectangular roofing panels, are easily envisioned. Those additional combinations are within the scope of a preferred embodiment.

Figure 16:
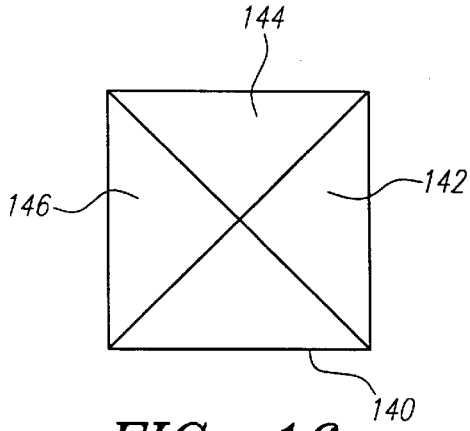
FIG. 16 is a top view of an assembled roof according to a fifth preferred embodiment.
Figure 17:
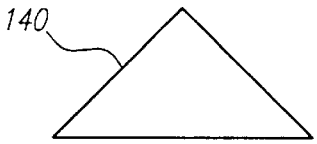
FIG. 17 is a front view of the first roofing panel of the fifth preferred embodiment.

A fifth preferred embodiment of the assembled roof 2 is shown in FIG. 16. As in the first preferred embodiment, the perimeter of the assembled roof 2 is preferably rectangular. It is understood that a square shape is included in the definition of the rectangular perimeter for each of the preferred embodiments. The fifth preferred embodiment is a pyramidal configuration, without the opening 12 that is present in the other preferred embodiments. In the fifth preferred embodiment, the assembled roof 2 includes a first roofing panel 140, a second roofing panel 142, a third roofing panel 146, and a fourth roofing panel 148. The first roofing panel 142, the second roofing panel 142, the third roofing panel 146, and the fourth roofing panel 148 are all preferably triangular. The triangular shape follows from the pyramidal shape of the assembled roof 2. The third roofing panel 144 is substantially identical to the first roofing panel 140, due to their symmetrical placement within the symmetrical structure of the assembled roof 2. The second roofing panel 142 and the fourth roofing panel 146 are substantially identical to one another for the same reason. If the perimeter of the assembled roof 2 is a square, all of the roofing panels are substantially identical. If the perimeter of the assembled roof 2 is rectangular, as discussed above with regard to the first four preferred embodiments, the first roofing panel 140 and the third roofing panel 144 will be substantially identical, and the second roofing panel 142 and the fourth roofing panel 146 will be substantially identical to one another, but form triangular shapes different from those formed by the first roofing panel 140 and the third roofing panel 144.

The material and coating of the first preferred embodiment, as disclosed above, apply here as well. Further, the assembly process proceeds in the same way for the fifth preferred embodiment as the first preferred embodiment; the roofing panels are placed onto rafters, secured to the rafters, and the joints are covered with ridge caps 30. In the fifth preferred embodiment, the rafters 24 preferably each extend from a corner of the underlying structure to the peak of the assembled roof 2, and the rafters 24 are preferably connected to one another at the peak of the assembled roof 2.

It will be apparent that in all of the preferred embodiments the roofing panels are larger than one-foot squares, thereby reducing the amount of rafter structure required to support the roofing panels. It will also be apparent that the preferred embodiments encompass assembled roofs 2 having perimeters with three sides, or having five or more sides. Each of the preferred embodiments meets or exceeds the standards for roofing set forth in the Uniform Building Code.

A preferred method for producing roofing panels for use in constructing a fabricated metal roof will now be disclosed. Bulk sheet metal can be obtained in coils. That is, a large sheet of metal is rolled into a coil for convenient transport and storage. However, bulk sheet metal may also be obtained in large flat sheets. To begin constructing roofing panels, a sheet metal coil is uncoiled in whole or in part, or a large flat sheet is obtained. If the roofing panels are to be painted a certain color, the painting step preferably follows. One or both sides of the sheet metal may be painted. The technology for painting a large sheet of metal, including but not limited to paint chemistry and means of application, are well known to one of ordinary skill in the art.

After painting the sheet metal, a protective coating is applied. As discussed above, the protective coating reduces or eliminates damage to the roofing panels during storage, handling, transport and assembly. In a preferred embodiment, the protective coating is polyvinyl chloride, applied by spraying it in liquid form onto the sheet metal. The technology for such spraying is known to those of ordinary skill in the art. Of course, the polyvinyl chloride coating may be applied to the sheet metal in other ways, such as by brushing it on. The polyvinyl chloride hardens into solid form on the sheet metal, bonding to the sheet metal, but not so strongly that it is not easily removable. Details regarding the bond between polyvinyl chloride and sheet metal are known to those of ordinary skill in the art. Further, other materials may be applied to the sheet metal as a protective coating; suitable materials harden into a solid form that is readily pulled off the roofing panels after assembly. Alternately, a sheet of protective material having an adhesive coating is applied to the roofing panel. The protective material may be paper, cardboard, or any protective substance to which an adhesive coating may be attached or which may be adhered to the sheet metal directly. The adhesive coating may be any adhesive capable of securely adhering to the metal roofing panels and easily removing from the metal roofing panels during installation. Thus, it is contemplated that a solid polyvinyl chloride sheet may be adhered directly to the sheet metal.

Optionally, the painted and coated sheet metal may then be rolled up into a coil again for storage. When it is time to process that painted and coated sheet metal, it is uncoiled once again.

In the next step, the sheet metal is cut into one or more roofing panels. By placing the coating onto the sheet metal before the cutting step, some protection is provided against damage during cutting and handling. The shape and size of the roofing panels, as discussed above, is determined by the desired size of the roof, and by the angle at which the roofing panels slope after assembly. It is contemplated that a plurality of sheets of metal could be cut at the same time to increase manufacturing efficiency.

Figure 18:
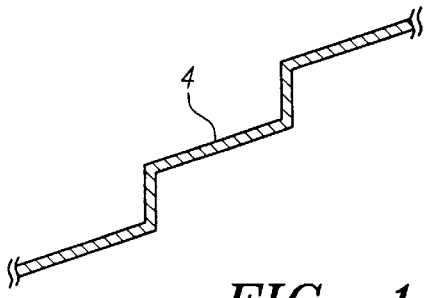
FIG. 18 is a cross-section view of the first roofing panel of FIG. 2.

Optionally, each roofing panel may then be fed into a die stamping machine fitted with one or more dies designed to give each roofing panel a desired decorative relief resulting in a textured panel. Such decorative relief patterns may include a pattern which gives the appearance of conventional roofs covered in overlapping boards, shingles, shakes, slate, tile, or other aesthetically-pleasing designs. The reference to "conventional roof" is meant to refer to the appearance of the variety of roof styles and designs which are well known to those skilled in the art. The production of dies and the use of a die stamping machine are well known to one of ordinary skill in the art. Other machines may be utilized to produce decorative relief in the roofing panels, if desired. Alternately, decorative relief may be created with hand tools or other objects to create a variety of textures. As used here, texture and decorative relief refer to indentations or protrusions in a roofing panel extending out of the plane of that roofing panel. When a roofing panel is textured, it is still considered to be substantially planar. In comparison with the overall surface area of each roofing panel, the contours created by texturing are not large enough to change the roofing panels into nonplanar structures. While the decorative relief having the appearance of overlapping wooden boards has a cross-section stairstep aspect, as shown in FIG. 18, a roofing panel having this decorative relief still lies substantially in a single plane, with the ridges of the decorative relief causing only small variations out of the dimension of the plane.

Finally, in a preferred embodiment, a plurality of roofing panels are packaged in a set which comprises all the roofing panels needed to install one complete assembled roof 2.

As will be appreciated by one skilled in the manufacturing process arts, it is within the scope of the method of the invention to perform one or more of the steps of the method as a continuous process.

While preferred embodiments have been disclosed in the context of an assembled roof 2 for a gazebo, the assembled roof 2 is not limited to use on a gazebo structure. The fabricated metal roof could be used equally advantageously on sheds, garages, playhouses, workshops, or other outbuildings. The fabricated metal roof could also be utilized on residential or commercial structures.

A preferred embodiment of a fabricated metal roof, and many of its attendant advantages, has thus been disclosed. It will be apparent, however, that various changes may be made in its form and components without departing from the spirit and scope of the invention, the embodiments hereinbefore described being merely a preferred or exemplary embodiment thereof Therefore, the invention is not to be restricted or limited except in accordance with the following claims and their legal equivalents.

What is claimed is:

1. A hip roof, comprising:

rafters having upper surfaces forming the structure of a hip roof having at least four contiguous and converging planes, at least four of the rafters being hip rafters;

a plurality of prefabricated sheet metal panels having formed decorative relief, each panel including opposed edges extending to approximately midway across two of the upper surfaces of the rafters, the plurality of panels being shaped together to form the four contiguous and converging planes, the panels extending to the hip rafters being trapezoidal or triangular in plan;

ridge caps extending over the sheet metal panels at the hip rafters; the plurality of prefabricated sheet metal panels including an interlocking edge, the interlocking edges of a portion of the panels each including a channel open toward the panel on the underside of the panel and the interlocking edges of another portion of the panels each including a channel open toward the panel on the upper side of the panel, the channels on the underside and the channels on the upper side being mutually interlocking.

2. The hip roof of claim 1, the rafters and the prefabricated sheet metal panels defining an opening between the upper edges of the planes.

3. The hip roof of claim 1, wherein each ridge cap located over one of said hip rafters supports abutting panels, said ridge caps having a substantially V-shaped cross section.

4. The hip roof of claim 1, wherein said roofing panels comprise sheet metal.

5. The hip roof of claim 1, further comprising a coating on at least one side of one or more of said roofing panels.

6. The hip roof of claim 5, wherein said coating is a plastic material.

7. The hip roof of claim 5, wherein said coating is polyvinyl chloride.

8. The hip roof of claim 1, wherein said decorative relief comprises the appearance of a conventional roof selected from the group consisting of the appearance of a roof formed from overlapping wooden panels, from slate shingles, from shake shingles, from composite shingles, and from tile.

9. The hip roof of claim 2, wherein the hip roof has a central opening, further comprising a center cap abutting one or more of said panels, said center cap substantially covering said opening.

10. The hip roof of claim 1, wherein the number and shape of the panels are chosen to minimize the number of roofing panels used to construct the hip roof.

* * * * *